US007198475B2

(12) United States Patent
Kim et al.

(10) Patent No.: US 7,198,475 B2
(45) Date of Patent: Apr. 3, 2007

(54) VALVE ASSEMBLY IN HERMETIC COMPRESSOR

(75) Inventors: Hyeon Kim, Busan-shi (KR); Jai-Seong Sim, Masan-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/380,982

(22) PCT Filed: Jul. 13, 2001

(86) PCT No.: PCT/KR01/01207

§ 371 (c)(1),
(2), (4) Date: Mar. 20, 2003

(87) PCT Pub. No.: WO02/25110

PCT Pub. Date: Mar. 28, 2002

(65) Prior Publication Data

US 2004/0013552 A1 Jan. 22, 2004

(30) Foreign Application Priority Data

Sep. 22, 2000 (KR) ..... 2000/55821

(51) Int. Cl.
*F04B 39/10* (2006.01)

(52) U.S. Cl. ..... 417/571; 137/856

(58) Field of Classification Search ..... 137/855, 137/856, 512, 454.4; 417/560, 569, 571
See application file for complete search history.

(56) References Cited

U.S. PATENT DOCUMENTS

| | | | | |
|---|---|---|---|---|
| 2,647,683 | A * | 8/1953 | Schweller | 417/571 |
| 5,456,287 | A | 10/1995 | Leu | |
| 5,934,305 | A * | 8/1999 | Cho | 417/571 |
| 6,296,014 | B1 * | 10/2001 | Miura et al. | 137/855 |

FOREIGN PATENT DOCUMENTS

| | | |
|---|---|---|
| CN | 1158389 | 9/1997 |
| DE | 110918 | 1/1975 |
| JP | 03260383 | * 11/1991 |

* cited by examiner

*Primary Examiner*—Michael Koczo, Jr.
(74) *Attorney, Agent, or Firm*—McKenna Long & Aldridge LLP

(57) ABSTRACT

A valve assembly of hermetic compressor is disclosed, in which a valve insertion groove (44) and (45) are formed. The valve insertion groove (44) includes a suction opening (42) on a head (40) provided between a cylinder (5) and a head cover (10), and the valve insertion groove (45) includes a discharge opening (43). An insertion type suction valve (50) and an insertion type discharge valve (60) are connected to said valve insertion grooves (44) and (45) respectively by spot welding. Accordingly, the valve assembly of hermetic compressor can make the valve smaller and simpler, so that reduced fabricating cost and improved productivity can be obtained. Also, at the same time dead volume can be reduced, thereby improving the compression efficiency.

7 Claims, 5 Drawing Sheets

VALVE ASSEMBLY IN HERMETIC COMPRESSOR

TECHNICAL FIELD

The present invention relates to a hermetic compressor, and more particularly, to a valve assembly of a hermetic compressor, for simplifying structures of a suction valve and a discharge valve that regulate flow of refrigerant to/from a cylinder, and minimizing a dead volume.

BACKGROUND ART

The compressor for drawing, compressing, and discharging a working fluid carries out compression of refrigerant gas passed through an evaporator to a high pressure and a high temperature in a refrigerating system of a refrigerator or an air conditioner. Particularly, of the compressors, one in which a motor mechanism part for generating a driving force is enclosed together with a compression mechanism part is called as a hermetic compressor. The hermetic compressors may be sorted, depending on a type of the compression mechanism part, as rotary compressors, reciprocating compressors, and scroll compressors, and the like, of which hermetic reciprocating compressor will be explained, with reference to the attached drawings. FIG. 1 illustrates a section of a related art hermetic reciprocating compressor.

Referring to FIG. 1, the related art hermetic reciprocating compressor is provided with a motor mechanism part for having a current applied thereto to generate a rotating force, and a compression mechanism part for compressing a refrigerant gas by using the rotating force from the motor mechanism part, both of which are enclosed in a shell 1 to form an enclosed space. The motor mechanism part has a stator 3 supported by springs seated on a bottom of the enclosed shell 1, and a rotator 4 inserted in the stator. The compression mechanism part, positioned in an upper part of the stator 3, has a cylinder block 'B' having a cylinder 5 for compression of the refrigerant gas on one side thereof and an inserting hole 6, a crankshaft 7 press fit in the inserting hole in the rotator 4 with an eccentric part 7*a* on a top thereof, a piston 8 for reciprocating in the cylinder, and a connecting rod 9 connected between the piston and the eccentric part of the crankshaft, for converting a rotating motion of the crankshaft into a reciprocating motion of the piston. The compression mechanism part has a valve assembly 'V' fitted to an end of the cylinder 5 for regulating flow of refrigerant to/from the cylinder 5, and a head cover 10 covered on the valve assembly to form a plenum, a flow passage of the refrigerant discharged from the valve assembly, further. There is a silencer 11 on one side of the head cover 10 in communication with an inside of the cylinder 5, for attenuating noise and guiding the refrigerant gas to the cylinder. There is an inlet tube 12 at one side of the shell 1 with an end thereof in the vicinity of an inlet to the silencer 11 for introduction of the refrigerant gas, and an outlet tube (not shown) at the other side of the shell for discharging the refrigerant gas. There is refrigerant oil fill in a bottom of the shell 1 for prevention of wear of various mechanical components.

Upon application of power to the hermetic reciprocating compressor, the rotor rotates by an interaction between the stator 3 and the rotor 4, to rotate the crankshaft 7. During rotation of the crankshaft 7, the connecting rod 9 coupled to the eccentric part 7*a* converts the rotating motion into a linear reciprocating motion, to move the piston 8 in the cylinder 5. In this instance, the refrigerant gas introduced through the inlet tube 12 flows to an inside of the cylinder 5 through the silencer 11 by the motion of the piston 8 and regulation of the valve assembly, compressed to a high temperature and a high pressure, and discharged through a outlet tube. FIG. 2 illustrates a disassembled perspective view of a related art valve assembly.

Referring to FIG. 2, the related art valve assembly is provided with a head 20 between an end of the cylinder 5 and the head cover 10, a suction valve 30 between the end of the cylinder and the head, and discharge means (not shown) between the head and the head cover. The head 20 has a body plate 21 with a thickness and an area having an inlet 22 and an outlet in one side thereof. The suction valve 30 has a thin plate 31 with an area the same with the body plate 21 having a slit 32 formed therein at a position opposite to the inlet 22, flap 33 for open/closing the inlet 22 by opening/closing the slit 32, and an outlet 34 formed opposite to the outlet 23 in the head on one side of the flap 33. Though not shown, the discharge means has a discharge valve for opening/closing the outlet in the head, a valve spring for reinforcing a rigidity of the discharge valve, and a retainer for limiting behavior of the discharge valve and the valve spring. The foregoing valve assembly 'V' is assembled by means of a plurality of fastening bolts 13 in a state the suction valve 30, the head 20, the discharge means, and the head cover 10 are fitted in the order to the end of the cylinder 5.

The Operation of the Valve Assembly will be Explained.

When the piston 8 moves from a top dead center to a bottom dead center in the cylinder 5, the flap. 33 on the suction valve 30 is bent by a suction force in the cylinder to open the inlet 22 in the head 20, when the refrigerant gas passed through the inlet tube and the silencer 11 in succession is introduced into the cylinder. Next, when the piston 8 moves from the bottom dead center to the top dead center, the flat 33 on the suction valve is restored to an original state, to close the inlet 22 in the head. On the same time with this, a pressure of the refrigerant gas in the cylinder 5 is built up gradually until a preset pressure is reached, when the discharge valve is opened by the pressure. Then, the refrigerant gas compressed in the cylinder is discharged to outside of the cylinder through the plenum via the outlet 34 in the suction valve 30 and the outlet 23 in the head.

However, the Related Art Valve Assembly has the Following Disadvantages.

First, even though only work required from the suction valve 30 is opening/closing of the inlet 22 in the head, the suction valve 30 has a size the same with the body plate 21 of the head. It means that the suction valve 30 has a size relatively greater than the required work thereof leading to increase a fabrication cost. And, due to above reason, the thin plate 31 is required to have the slit 32 at a position opposite to the inlet 22 in the head, and an outlet 34 at a position opposite to the outlet 23 in the head, due to which a structure of the suction valve 30 becomes complicate, and fabrication and assembly steps are increased to drop a productivity. The foregoing problems are applicable also to the discharge means.

Second, the slit 32 in the suction valve for the flap 33 forms a dead space, that is a main reason of a refrigerant compression efficiency drop.

DISCLOSURE OF INVENTION

Accordingly, the present invention is directed to a valve assembly in a hermetic compressor that substantially obviates one or more of the problems due to limitations and disadvantages of the related art.

An object of the present invention is to provide a valve assembly in a hermetic compressor, in which structures of a suction valve and a discharge valve that regulate flow of refrigerant gas to/from a cylinder are simplified, for minimizing a dead space formed in a step of compression of refrigerant, to enhance a compression efficiency.

Other object of the present invention is to provide a valve assembly in a hermetic compressor, in which a dead space formed in a step the refrigerant gas is compressed is minimized, for enhancing a compression efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the valve assembly in a hermetic compressor, having a head between a cylinder for compressing refrigerant gas therein, and a head cover for forming a discharge passage of the compressed refrigerant gas, with an inlet for introduction of the refrigerant gas into the cylinder, and a suction valve for open/closing the inlet in the head, includes a valve inserting recess in one side of the head facing the cylinder having area and depth of required forms inclusive of the inlet, wherein the suction valve is an inserting type suction valve inserted in the valve inserting recess for open/closing the inlet by a suction force and a compression force inside of the cylinder.

In other aspect of the present invention, there is provided a valve assembly in a hermetic compressor having a head between a cylinder for compressing refrigerant gas therein, and a head cover for forming a discharge passage of the compressed refrigerant gas, with an outlet for discharge of compressed refrigerant gas from the cylinder, and a discharge valve for open/closing the outlet in the head, including a valve inserting recess in one side of the head facing the head cover having area and depth of required forms inclusive of the outlet, wherein the discharge valve is an inserting type discharge valve inserted in the valve inserting recess for open/closing the outlet by a suction force and a compression force inside of the cylinder.

In another aspect of the present invention, there is provided a valve assembly in a hermetic compressor, having a head between a cylinder for compressing refrigerant gas therein, and a head cover for forming a discharge passage of the compressed refrigerant gas, with an inlet for introduction of the refrigerant gas into the cylinder and an outlet for discharging the refrigerant gas from the cylinder, a suction valve for open/closing the inlet in the head, and a discharge valve for open/closing the outlet in the head, including a first valve inserting recess in one side of the head facing the cylinder having area and depth of required forms inclusive of the inlet, and a second valve inserting recess in the other side of the head facing the head cover having area and depth of required forms inclusive of the outlet, wherein the suction valve is an inserting type suction valve inserted in the first valve inserting recess for open/closing the inlet by a suction force and a compression force inside of the cylinder, and the discharge valve is an inserting type discharge valve inserted in the second valve inserting recess for open/closing the outlet by the suction force and the compression force inside of the cylinder.

The small sized and simple structured valves of the valve assembly in a hermetic compressor of the present invention for open/closing an inlet and an outlet to/from the cylinder permit to reduce fabrication steps that improves a productivity, and a dead space that improves a dead space.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings. In explanation of the embodiments of the present invention, identical parts will be given the same names and reference symbols, and additional explanations of which will be omitted.

Figure 1:
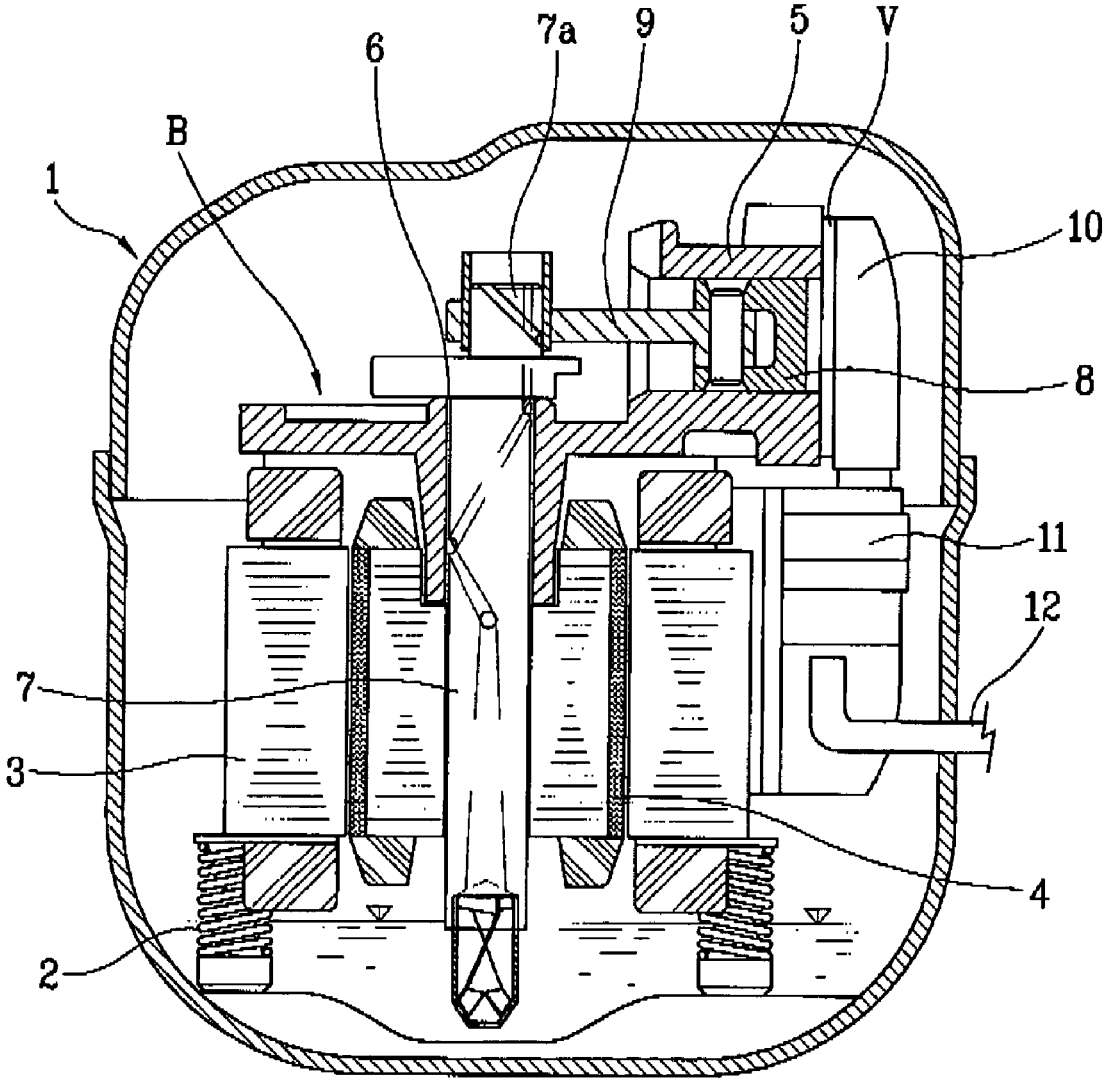
FIG.1 Prior Art
FIG. 1 illustrates a section of a related art hermetic reciprocating compressor.
Figure 2:
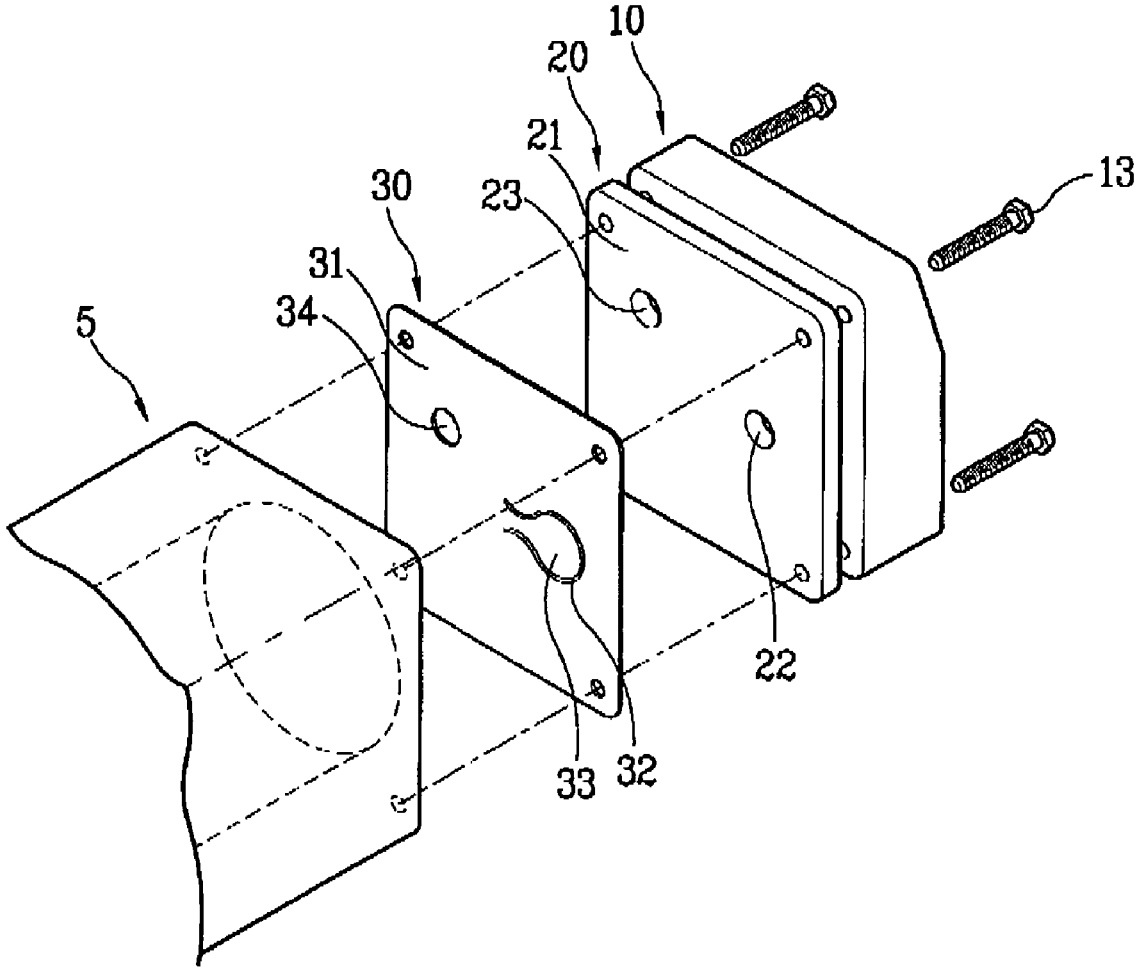
FIG. 2 Prior Art
FIG. 2 illustrates a disassembled perspective view of a related art valve assembly.
Figure 3:
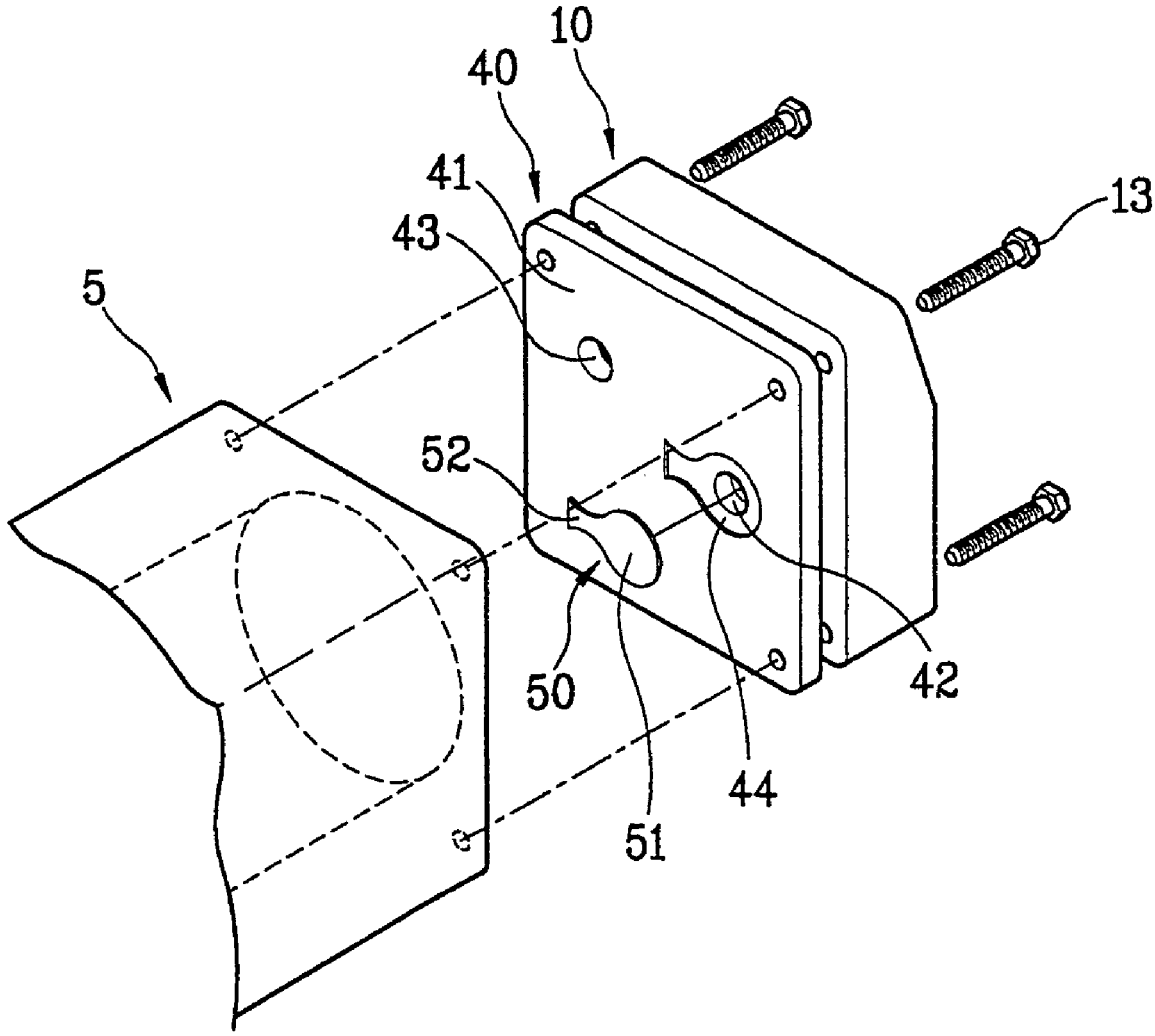
FIG. 3 illustrates a disassembled perspective view of a valve assembly of a hermetic compressor in accordance with a preferred embodiment of the present invention.

Referring to FIG. 1, the hermetic compressor of the present invention includes a motor mechanism part for generating a driving power, and a compression mechanism part for receiving a driving power from the motor mechanism part to compress refrigerant gas. The compression mechanism part includes a cylinder block 'B' above the motor mechanism part having a cylinder 5 and an inserting hole 6 at one side thereof for compressing the refrigerant, a crankshaft 7 press fit in a rotor 4 of the motor mechanism part through the inserting hole 6 having an eccentric part 7*a* at a top thereof, a piston 8 for making a linear reciprocating motion within the cylinder, and a connecting rod 9 for connecting the piston and the eccentric part of the crankshaft for converting a rotating motion of the crankshaft into a linear reciprocating motion of the piston. The compression mechanism part includes a valve assembly 'V' fitted to an end of the cylinder 5 for regulating flow of the refrigerant gas to/from the cylinder 5, and a head cover 10 covered on the valve assembly for forming a plenum, a refrigerant gas passage from the valve assembly. FIG. 3 illustrates a disassembled perspective view of a valve assembly of a hermetic compressor in accordance with a preferred embodiment of the present invention.

Referring to FIG. 3; the valve assembly in accordance with a preferred embodiment of the present invention includes a head 40 fitted between the end of the cylinder 5 and the head-cover 10, a suction valve 50 inserted in one side of the head facing the cylinder, and a discharge means (not shown) fitted between the head cover 10 and the head for regulating discharge of the refrigerant gas.

The head 40 is a body plate 41 with a thickness and area having an inlet 42 at one side thereof, and an outlet 43 on one side of the inlet. There is a valve inserting hole 44 inclusive of the suction hole 42 recessed in one side of the body plate 41, i.e., in a surface of the body plate 41 facing the cylinder 5 in a predetermined form, area, and depth.

The suction valve 50 is an inserting type suction valve inserted in, and fixed to a valve inserting recess 44 for closing/opening the inlet 42 by suction/compression force in the cylinder 5. To do this, the inserting type suction valve 50 includes an open/closing part 51 having an area enough to cover the inlet 42 in the head, and a fixed part 52 extended from the open/closing part. The inserting type suction valve 50 is formed of thin plate having a form identical to the valve inserting recess 44. The inserting type suction valve 50 is inserted in the valve inserting recess 44 such that the open/closing part 51 closes the inlet 42, and the fixed part 52 is fixed to one side of the valve inserting recess by spot welding.

Figure 4:
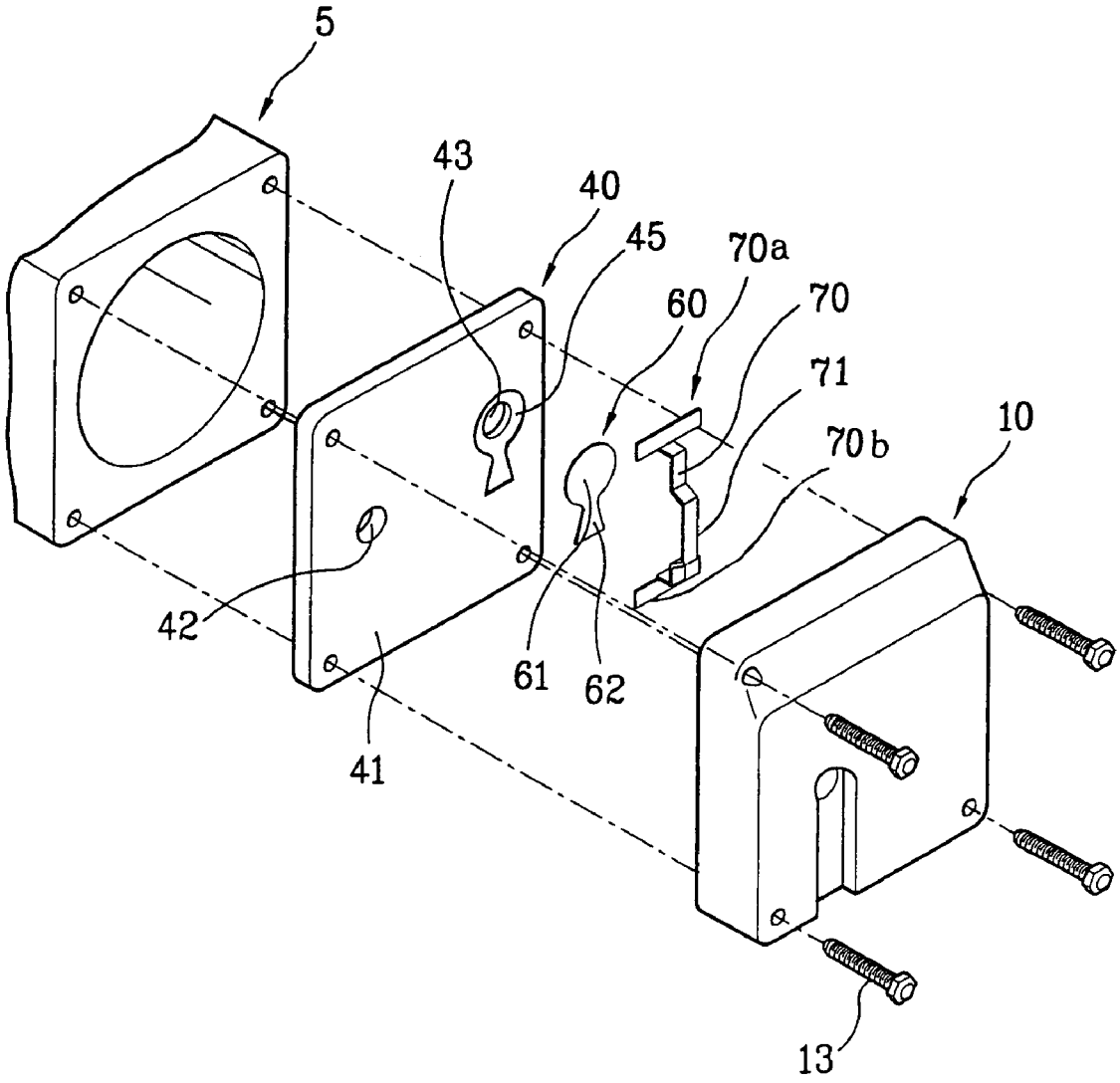
FIG. 4 illustrates a disassembled perspective view of a valve assembly of a hermetic compressor in accordance with another preferred embodiment of the present invention; and, FIGS. 5 and 6 illustrate sections each showing operation of a valve assembly of a hermetic compressor of the present invention.

The valve assembly is assembled to the cylinder by fastening a plurality of fastening bolts 13 at a time after the head 40 is placed on the end of the cylinder 5 such that a surface of the valve assembly having the inserting type suction valve 50 is fitted thereto is positioned inside of the cylinder, the head cover 10 having the plenum forming a discharge passage of the refrigerant gas is positioned on the other side of the head, and the discharge means is positioned between the head and the head cover, when the inlet 42 in the head is made to be in communication with the silencer, and the outlet 43 is made to be in communication with the head cover 10, and the head cover is made to be in communication with the outlet tube. The operation of the valve assembly will be explained in detail in the following embodiment. FIG. 4 illustrates a disassembled perspective view of a valve assembly of a hermetic compressor in accordance with another preferred embodiment of the present invention.

Referring to FIG. 4, the valve assembly in accordance with another preferred embodiment of the present invention includes a head 40 fitted between an end of a cylinder 5 and a head cover 10, a suction means (not shown) between the cylinder and the head for regulating suction of the refrigerant gas, and a discharge valve 60 inserted in the other surface of the head facing the head cover 10.

The head 40 is a body plate 41 with predetermined thickness and area having an inlet in one side and an outlet 43 on one side of the inlet. There is a valve inserting recess 45 of a predetermined size, area, and depth, inclusive of the outlet 43, formed in one side of the body plate 41, i.e., in a surface of the body plate 41 facing the head cover 10.

The discharge valve 60 is an inserting type discharge valve inserted in and fixed to the valve inserting recess 45 for open/closing the outlet 43 by means of a suction force and a discharge force in the cylinder 5. To do this, the inserting type discharge valve 60 has an open/closing part 61 having an area enough to cover the outlet 43 in the head, and a fixed part 62 extended from the open/closing part. The inserting type discharge valve 60 is also formed of thin plate of a form in conformity with the valve inserting recess 45. The inserting type discharge valve 60 is inserted in the valve inserting recess 45 such that the open/closing part 61 closes the outlet 60, and the fixed part 62 is spot welded to one side of the valve inserting recess. There is a retainer 70 for limiting motion of the discharge valve 60 provided to the head 40 or the head cover 10, and a valve spring (not shown) for reinforcing a rigidity of the inserting type discharge valve between the inserting type discharge valve and the retainer, if necessary. As one of ordinary skill in the art would appreciate from FIGS. 4 and 5, the retainer 70 has a first end 70*a* which fixes to the head 40 (see FIG. 5) and a second end 70*b* which also fixes to the head 40 (see FIG. 5). Furthermore, the retainer 70 also includes a stopper 71 disposed between the first end 70*a* and the second end 70*b*.

The valve assembly is assembled to the cylinder by fastening a plurality of fastening bolts 13 at a time after the head 40 is placed on the end of the cylinder 5 such that a surface of the valve assembly having the inserting type discharge valve 60 is fitted thereto faces the head cover 10, the head cover 10 having the plenum forming a discharge passage of the refrigerant gas is positioned on the other side of the head, and the suction means (not shown) is positioned between the cylinder 5 and the head 40, when the plenum and the valve inserting recess 45 form one enclosed space, in which the inserting type discharge valve 60 and the retainer 70 are positioned. The plenum of the head cover is made to be in communication with the outlet tube. The operation of the foregoing valve assembly will be explained in a following embodiment in detail.

In the meantime, a valve assembly in accordance with another preferred embodiment of the present invention, having both the inserting type suction valve and the inserting type discharge valve, will be explained with reference to FIGS. 3 and 4 in detail.

Referring to FIGS. 3 and 4, the valve assembly in accordance with another preferred embodiment of the present invention includes a head 40 fitted between an end of a cylinder 5 and a head cover 10, a suction valve 50 inserted in one side of the head facing the cylinder, and a discharge valve 60 inserted in the other surface of the head facing the head cover 10.

The head 40 is a body plate 41 with predetermined thickness and area having an inlet 42 in one side and an outlet 43 on one side of the inlet. There is a first valve inserting recess 44 inclusive of the inlet 42 in one side of the body plate 41, i.e., in a surface of the body plate 41 facing the cylinder 5, and a second valve inserting recess 45 inclusive of the outlet 43 in the other side of the body plate 41. Each of the first valve inserting recess 44 and the second valve inserting recess 45 has a predetermined form, area, and depth in the body plate 41.

The suction valve 50 is an inserting type suction valve inserted in, and fixed to the first valve inserting recess 44 for open/closing the inlet 42 by means of a suction force and a discharge force in the cylinder 5. To do this, the inserting type suction valve 50 has an open/closing part 61 having an area enough to close the inlet 42 in the head, and a fixed part 52 extended from the open/closing part. The inserting type suction valve 50 is formed of thin plate of a form in conformity with the first valve inserting recess 44. The inserting type suction valve 50 is inserted in the first valve inserting recess 44 such that the open/closing part 51 closes the inlet 42, and the fixed part 52 is spot welded to one side of the first valve inserting recess.

The discharge valve 60 is an inserting type discharge valve inserted in and fixed to the second valve inserting recess 45 for open/closing the outlet 43 by means of a suction force and a discharge force in the cylinder 5. To do this, the inserting type discharge valve 60 also has an open/closing part 61 having an area enough to close the outlet 43 in the head, and a fixed part 62 extended from the open/closing part. The inserting type discharge valve 60 is also formed of thin plate of a form in conformity with the second valve inserting recess 45. The inserting type discharge valve 60 is inserted in the second valve inserting recess 45 such that the open/closing part 61 closes the outlet 60, and the fixed part 62 is spot welded to one side of the second valve inserting recess. There is a retainer 70 for limiting motion of the discharge valve 60 provided to the head 40 or the head cover 10, and a valve spring (not shown) for reinforcing a rigidity of the inserting type discharge valve between the inserting type discharge valve and the retainer, if necessary.

The valve assembly is assembled to the cylinder by fastening a plurality of fastening bolts 13 at a time after the head 40 is placed on the end of the cylinder 5 such that a surface of the valve assembly having the inserting type suction valve 50 is fitted thereto is positioned in the cylinder, the head cover 10 having the plenum forming a discharge passage of the refrigerant gas is positioned on the other side of the head, and the retainer 70 is positioned at the head 40 or the head cover 10, when the plenum and the second valve inserting recess 45 in the head 40 form one enclosed space, in which the inserting type discharge valve 60 is positioned. The inlet 42 in the head is made to be in communication with the silencer, and the outlet 43 in the head is made to be in communication with the outlet tube through the plenum in the head cover 10. The operation of the foregoing valve assembly in a hermetic compressor will be explained in detail.

Upon application of a power, the rotating force from the motor mechanism part is transmitted to the crankshaft 7. Then, the connecting rod 9 coupled to the eccentric part 7*a* of the crankshaft converts the rotating force into a linear reciprocating motion and transmits to the piston 8. Next, the piston draws, compresses, and discharge refrigerant gas as the piston reciprocates inside of the cylinder 5.

Figure 5:
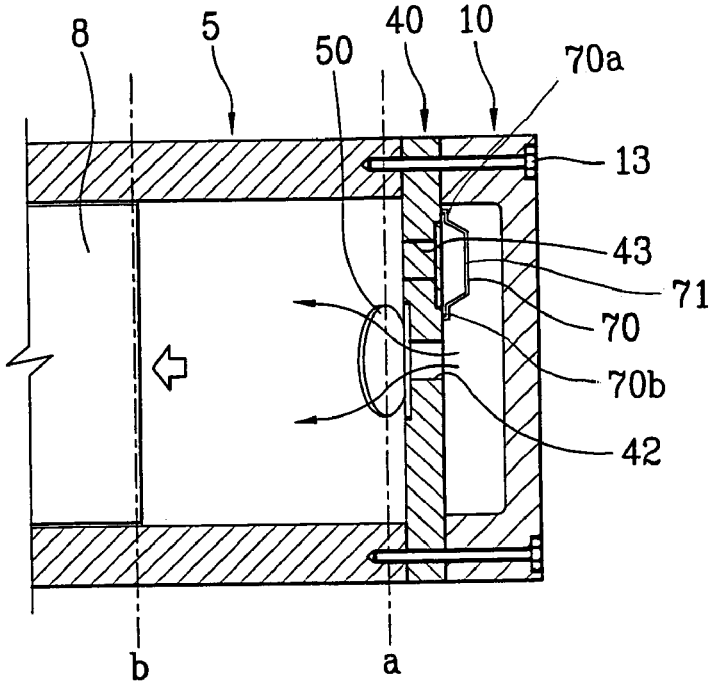
Figure 6:
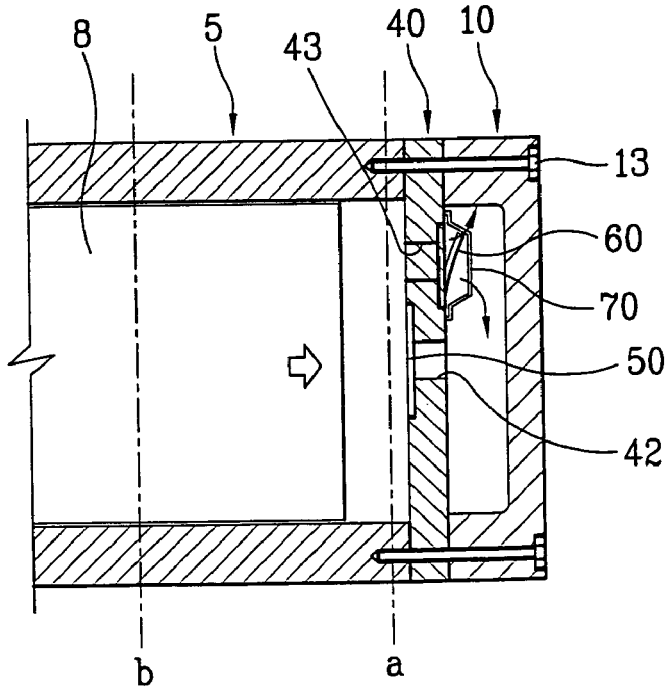

A process the piston draws the refrigerant gas, and discharges finally as the piston 8 moves in the cylinder will be explained, with reference to the attached drawings. FIGS. 5 and 6 illustrate sections each showing operation of a valve assembly of a hermetic compressor of the present invention.

Referring to FIG. 5, the inserting type discharge valve 60 closes the outlet 43 as the inserting type discharge valve 60 is moved by the suction force produced in the cylinder as the piston 8 moves from a top dead center 'a' to a bottom dead center 'b' of the cylinder 5, and the inserting type suction valve 50 opens the inlet 42 in the head 40 as the open/closing part 51 is bent by the suction force, when the refrigerant gas passed through the inlet tube and the silencer 11 in succession is drawn into the cylinder 5.

Referring to FIG. 6, when the piston 8 moves from the bottom dead center 'b' to the top dead center 'a', the inserting type suction valve 50 closes the inlet 42 in the head as the inserting type suction valve 50 restores an original position by its own rigidity and a pressure difference. On the same time with this, the refrigerant gas in the cylinder 5 is compressed gradually, to reach to a preset pressure, when the open/closing part 61 of the inserting type discharge valve 60 is bent to open the outlet 43 in the head. Then, the refrigerant gas from the outlet is discharged to the outlet tube via the plenum 'D' in the head cover 10.

The valve assembly in a hermetic compressor of the present invention has the following advantages.

The valve inserting recesses 44 and 45 in the head 40 and the inserting type suction valve 50 and the inserting type discharge valve 60 inserted therein respectively permit to reduce a production cost and simplify a fabrication process because the valve can be fabricated small and simple. The assembly process is simple because the head 40 with the inserting type valves 50 and 60 assembled therein is assembled to the cylinder 5 and the head cover 10, that permits improvement in productivity.

Next, a dead space formed by the piston 8 and the head 40 in the cylinder, i.e., in the compression space can be minimized, because the inserting type suction valve 50 is inserted and fixed to the valve inserting type recess 44 in the head, thereby improving a compression efficiency of the refrigerant gas.

It will be apparent to those skilled in the art that various modifications and variations can be made in the valve assembly of a hermetic compressor of the present invention without departing from the spirit or scope of the invention. Thus, it is intended that the present invention cover the modifications and variations of this invention provided they come within the scope of the appended claims and their equivalents.

INDUSTRIAL APPLICABILITY

The small and simple valves for respectively open/closing inlet/outlet of refrigerant gas of the valve assembly in the hermetic compressor of the present invention can reduce a production cost and simplify a fabrication process.

The assembly of the valves to the cylinder and the head cover in a state the valves are fitted to the head permits to make the assembly process simple, which can improve a productivity at the end.

The valve assembly in a hermetic compressor of the present invention in a form an inserting type suction valve is inserted and fixed in a valve inserting recess formed in a head can minimize a dead space of a compression space the refrigerant compressed therein, to improve a compression efficiency of the refrigerant gas.

The invention claimed is:

1. A valve assembly in a hermetic compressor having a head between a cylinder for compressing refrigerant gas therein and a head cover for forming a discharge passage of the compressed refrigerant gas, with an inlet for introduction of the refrigerant gas into the cylinder and an outlet for discharging the refrigerant gas from the cylinder, a suction valve for opening and closing the inlet in the head, and a discharge valve for opening and closing the outlet in the head, comprising:

a valve inserting recess in one side of the head facing the cylinder having an area and a depth which accommodates the inlet, wherein the suction valve is an inserting type suction valve inserted in the valve inserting recess for opening and closing the inlet by a suction force and a compression force inside of the cylinder; and a retainer provided at the head, wherein the retainer is configured to limit discharge valve movement and has both ends fixed to a side of the head and a stopper provided between the ends.

2. The valve assembly as claimed in claim 1, wherein the inserting type suction valve has a form in conformity with the valve inserting recess.

3. The valve assembly as claimed in claim 1, wherein the inserting type suction valve includes one side fixed to the valve inserting recess by spot welding.

4. A valve assembly in a hermetic compressor having a head between a cylinder for compressing refrigerant gas therein and a head cover for forming a discharge passage of the compressed refrigerant gas, with an outlet for discharge of compressed refrigerant gas from the cylinder and a discharge valve for opening and closing the outlet in the head, comprising:

a valve inserting recess in one side of the head facing the head cover having an area and a depth which accommodates the outlet, wherein the discharge valve is an inserting type discharge valve inserted in the valve inserting recess for opening and closing the outlet by a suction force and a compression force inside of the cylinder; and a retainer provided at the head, wherein the retainer is configured to limit discharge valve movement and has both ends fixed to a side of the head and a stopper provided between the ends.

5. The valve assembly as claimed in claim 4, wherein the inserting type discharge valve has a form in conformity with the valve inserting recess.

6. The valve assembly as claimed in claim 4, wherein the inserting type discharge valve includes one side fixed to the valve inserting recess by spot welding.

7. A valve assembly in a hermetic compressor having a head between a cylinder for compressing refrigerant gas therein, and a head cover for forming a discharge passage of the compressed refrigerant gas, with an inlet the for introduction of the refrigerant gas into the cylinder and an outlet for discharging the refrigerant gas from the cylinder, a suction valve for opening and closing the inlet in the head, and a discharge valve for opening and closing the outlet in the head, comprising:

a first valve inserting recess in one side of the head facing the cylinder having an area and a depth which accommodates the inlet, and a second valve inserting recess in the other side of the head facing the head cover having an area and a depth which accommodates the outlet, wherein the suction valve is an inserting type suction valve inserted in the first valve inserting recess for opening and closing the inlet by a suction force and a compression force inside of the cylinder, and the discharge valve is an inserting type discharge valve inserted in the second valve inserting recess for opening and closing the outlet by the suction force and the compression force inside of the cylinder; and a retainer provided at the head, wherein the retainer is configured to limit discharge valve movement and has both ends fixed to a side of the head and a stopper provided between the ends.

* * * * *

UNITED STATES PATENT AND TRADEMARK OFFICE

CERTIFICATE OF CORRECTION

PATENT NO. : 7,198,475 B2
APPLICATION NO. : 10/380982
DATED : April 3, 2007
INVENTOR(S) : Hyeon Kim et al.

It is certified that error appears in the above-identified patent and that said Letters Patent is hereby corrected as shown below:

On the title page item (54) and col. 1, line 1, should read --(54) Valve Assembly of Hermetic Compressor--

Signed and Sealed this

Twenty-second Day of May, 2007

JON W. DUDAS
*Director of the United States Patent and Trademark Office*